US010092112B1

(12) United States Patent
Waszak

(10) Patent No.: US 10,092,112 B1
(45) Date of Patent: Oct. 9, 2018

(54) INFANT SUPPORT DEVICE

(71) Applicant: Christopher Waszak, Crown Point, IN (US)

(72) Inventor: Christopher Waszak, Crown Point, IN (US)

( * ) Notice: Subject to any disclaimer, the term of this patent is extended or adjusted under 35 U.S.C. 154(b) by 202 days.

(21) Appl. No.: 15/041,225

(22) Filed: Feb. 11, 2016

(51) Int. Cl.
*A47D 1/00* (2006.01)
*A47D 15/00* (2006.01)
*B60N 2/28* (2006.01)

(52) U.S. Cl.
CPC ..... *A47D 1/00* (2013.01); *A47D 15/006* (2013.01); *B60N 2/286* (2013.01); *B60N 2/2806* (2013.01); *B60N 2/2821* (2013.01); *B60N 2/2863* (2013.01); *B60N 2/2869* (2013.01)

(58) Field of Classification Search
CPC ..... A47D 1/00; A47D 15/006; B60N 2/2869; B60N 2/2821; B60N 2/2806; B60N 2/286; B60N 2/2863
USPC ..... 297/344.21, 256.12, 256.1, 256.11, 297/256.13, 256.14, 250.1
See application file for complete search history.

(56) References Cited

U.S. PATENT DOCUMENTS 4,971,392 A * 11/1990 Young ..... B60N 2/2821 297/256.12
6,015,188 A * 1/2000 Yundt ..... A47C 3/16 297/242
6,705,676 B1 * 3/2004 Berringer ..... B60N 2/1839 297/250.1
7,073,859 B1 * 7/2006 Wilson ..... B60N 2/0232 297/250.1
7,175,535 B1 * 2/2007 Marmentini ..... A47D 13/025 297/273
7,575,276 B1 * 8/2009 Henry ..... B60N 2/2821 297/256.12
8,702,169 B2 * 4/2014 Abadilla ..... B60N 2/062 297/256.12
8,967,716 B2 * 3/2015 Mountz ..... A47C 9/02 297/256.12
9,487,111 B2 * 11/2016 Lake ..... B60N 2/2869
2002/0145319 A1 * 10/2002 Tsugimatsu ..... B60N 2/2806 297/256.13
2003/0102702 A1 * 6/2003 Daley ..... A47D 1/004 297/250.1

* cited by examiner

*Primary Examiner* — Syed A Islam
(74) *Attorney, Agent, or Firm* — Lech Law, LLC; Robert R. Lech

(57) ABSTRACT

An infant support device is disclosed. The infant support device comprises a base, a swivel assembly and an support element. The infant support device supports an infant and allows the infant to rotate 360 degrees around a generally vertical axis normal to the device.

15 Claims, 4 Drawing Sheets

INFANT SUPPORT DEVICE

TECHNICAL FIELD

The present application relates generally to support devices for infants, and more particularly to an infant support device including a base, a swivel assembly and a support element.

STATEMENT REGARDING FEDERALLY SPONSORED RESEARCH

No government monies were used in the development of the subject matter of this application.

BACKGROUND

A number of devices for supporting infants are well known. Such devices include child car seats, bassinettes, cribs, bouncy chairs, and the like. No known infant support device positions the infant on its stomach while allowing the infant to safely investigate his/her environment. There is a need for a device that safely allows an inquisitive infant to easily achieve a 360 view of his/her environment.

SUMMARY

According to a first aspect of the present application, a first example infant support device is disclosed. The first example infant support device comprises a base, a swivel assembly and a support element. A first end of the swivel assembly is connected to the support element. A second end of the swivel assembly is connected to the base. The first and second ends of the swivel assembly are rotatable with respect to each other such that they may rotate a full 360 degrees.

According to a second aspect of the present application, a second infant support device is disclosed. The second example infant support device comprises: a base, wherein the base is configured to rest on a substantially flat, horizontal surface, the base defining a generally circular recessed cavity; a bearing disposed within the cavity defined by the base; a swivel frame having a first end and a second end, the first end being generally circular and sized to fit within the cavity defined by the base; a retaining flange attached to the base, the retaining flange retaining the swivel frame and the bearing in vertical relation to the base; and a support element attached to the second end of the swivel frame, whereby the support element and the swivel frame are rotatable 360 degrees with respect to the base about an axis normal to the base and the second infant support device.

An object of the present application is to describe an infant support device that enables interaction by the infant. A further object of the present application is to describe an infant support device that enables 360 degree rotation, thereby providing a varied view of an infant's surroundings. These and other objects, features, and/or advantages may accrue from various aspects of embodiments of the present application, as described in more detail below.

BRIEF DESCRIPTION OF THE DRAWINGS

The accompanying figures, which are incorporated in and constitute a part of the specification, illustrate various example systems, devices methods, and so on, and are used merely to illustrate various example embodiments. Like reference numerals refer to identical or similar components or steps. It should be noted that the various components depicted in the figures may not be drawn to scale, and that the various assemblies and designs depicted in the figures are presented for purposes of illustration only, and should not be considered in any way as limiting.

DETAILED DESCRIPTION

Figure 1:
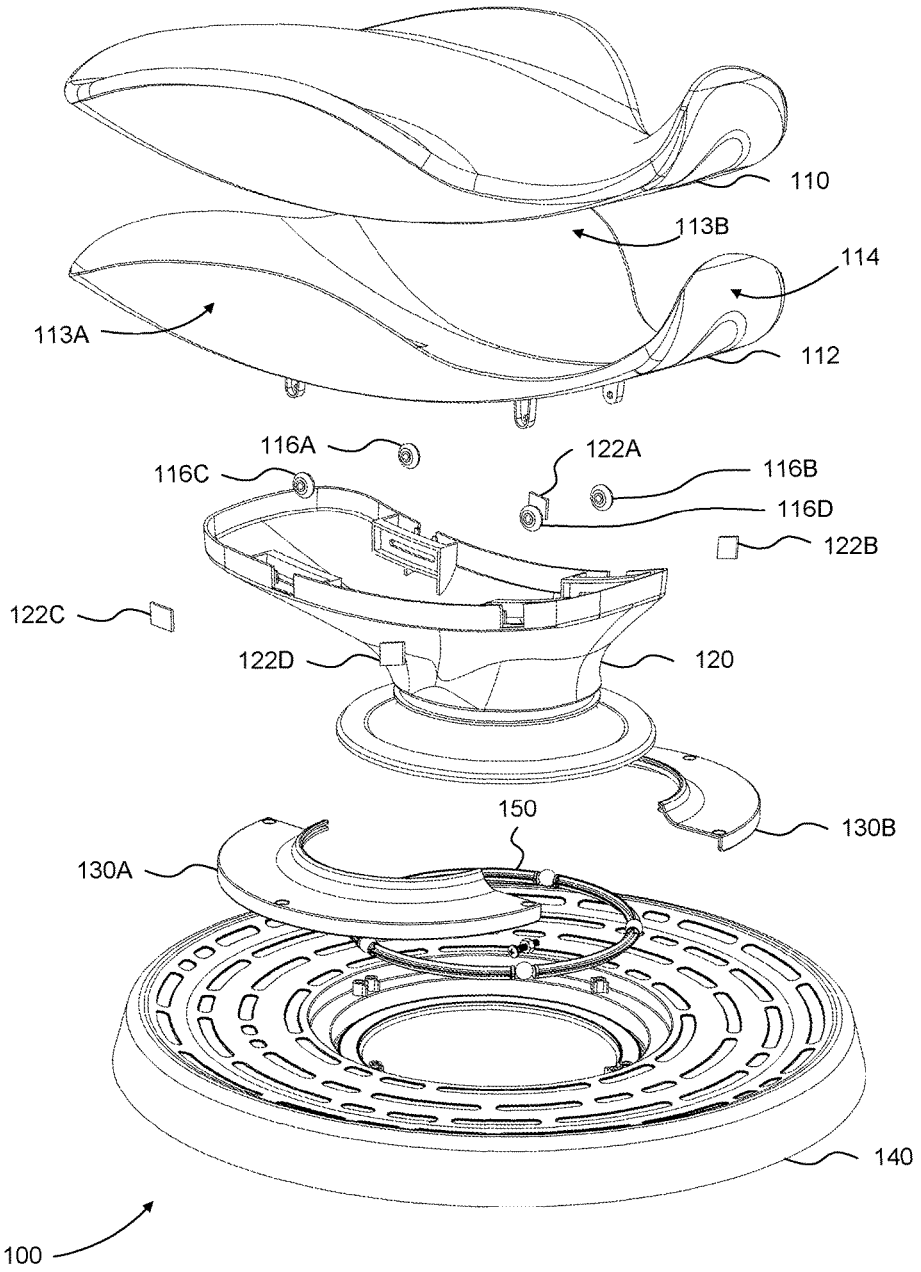
FIG. 1 illustrates an exploded perspective view of a first example infant support device in accordance with this application.

Particular embodiments of an example device will now be described in greater detail with reference to the figures. Like reference numerals apply to similar parts throughout the several views.

FIG. 1 illustrates an exploded perspective view of a first example infant support device 100 in accordance with this application. Example infant support device 100 comprises a contoured cushion 110. Cushion 110 is configured to receive and support an infant using device 100. In the example embodiment, cushion 110 may be manufactured of a flexible material that will provide comfort to an infant using device 100. Cushion 110 may be further configured to mate with support element 112. In the example embodiment, support element 112 may be a rigid element that receives and supports cushion 110.

In the example embodiment, support element 112 comprises several contours. For example, support element 112 defines two side contours, 113A and 113B. The side contours 113A and 113B retain an infant within the device, thereby preventing the infant from laterally falling out of the device. The example support element 112 further defines a rear contour 114. The rear contour 114 retains in infant within the device from the rear, thereby preventing the infant from sliding out of the rear of the device. In addition, the upper surface of example support element 112 is disposed at a gently upward angle, thereby preventing the infant from sliding out of the forward portion of the device.

Cushion 110 is generally formed to match the contours of the support element 112. Cushion 110 may be retained within of support element 112 through gravity and the contours of support element 112. Alternatively, cushion 110 may be fastened to support element 112 by hook and loop fasteners, glue, mechanical fasteners, clips or the like.

Support element 112 is attached to a swivel frame 120. In the example, embodiment, Support element 112 and swivel frame 120 are secured together using fasteners 116A-116D, and the fasteners are hidden from view by covers 122A-

122D. In the example embodiment, covers 122A-122D snap into similarly sized apertures defined by swivel frame 120 to provide a pleasing appearance.

Swivel frame 120 comprises a generally circular lower edge which is configured to receive a bearing or set of bearings 150, and the lower edge of swivel frame 120 is sized to mate with a base 140. Base 140 supports and distributes the weight of the device 100 as well as the weight of an infant using the device. Base 140 defines a generally circular cavity which receives bearing 150 and the lower edge of swivel frame 120.

When properly assembled, bearing 150 is disposed between the lower surface of swivel frame 120 and the upper surface within the cavity defined by base 140. Bearing 150 is disposed between, and in frictional contact with, the lower surface of swivel frame 120 and the upper surface of base 140 within the cavity defined by base 140. Retaining flange 130 is secured to base 140, thereby holding swivel frame 120, bearing 150 and base 140 in vertical relation to each other. Swivel frame 120, bearing 150, and retaining flange 130 define a swivel assembly 160 that permits 360 degree rotation of swivel frame 120 with respect to base 140.

Figure 2:
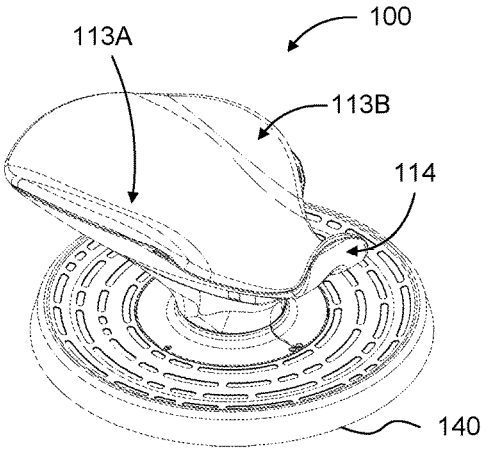
FIG. 2 illustrates a perspective view of the example infant support device of FIG. 1.
Figure 3:
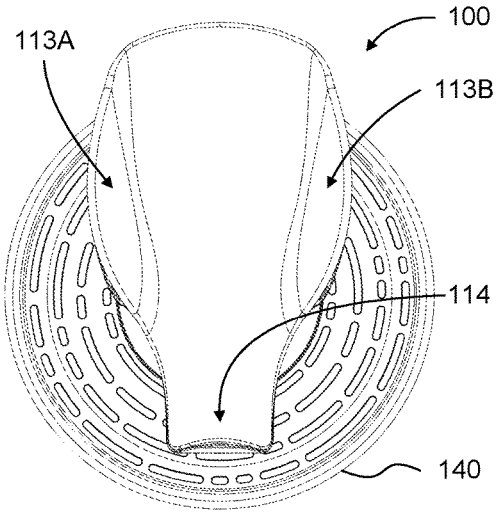
FIG. 3 illustrates a top view of the example infant support device of FIG. 1.
Figure 4:
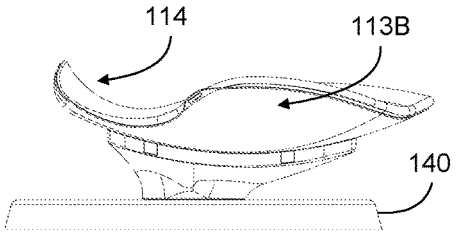
FIG. 4 illustrates a rear view of the example infant support device of FIG. 1.
Figure 5:
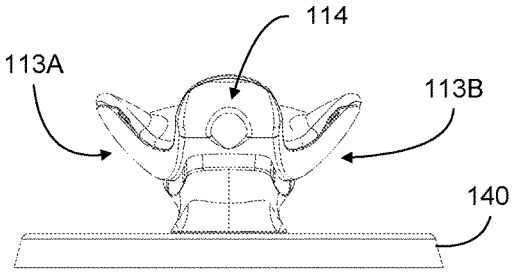
FIG. 5 illustrates a right side view of the example infant support device of FIG. 1.

FIG. 2 illustrates a perspective view of the example infant support device of FIG. 1. FIG. 3 illustrates a top view of the example infant support device of FIG. 1. FIG. 4 illustrates a rear view of the example infant support device of FIG. 1. FIG. 5 illustrates a right side view of the example infant support device of FIG. 1.

Figure 6:
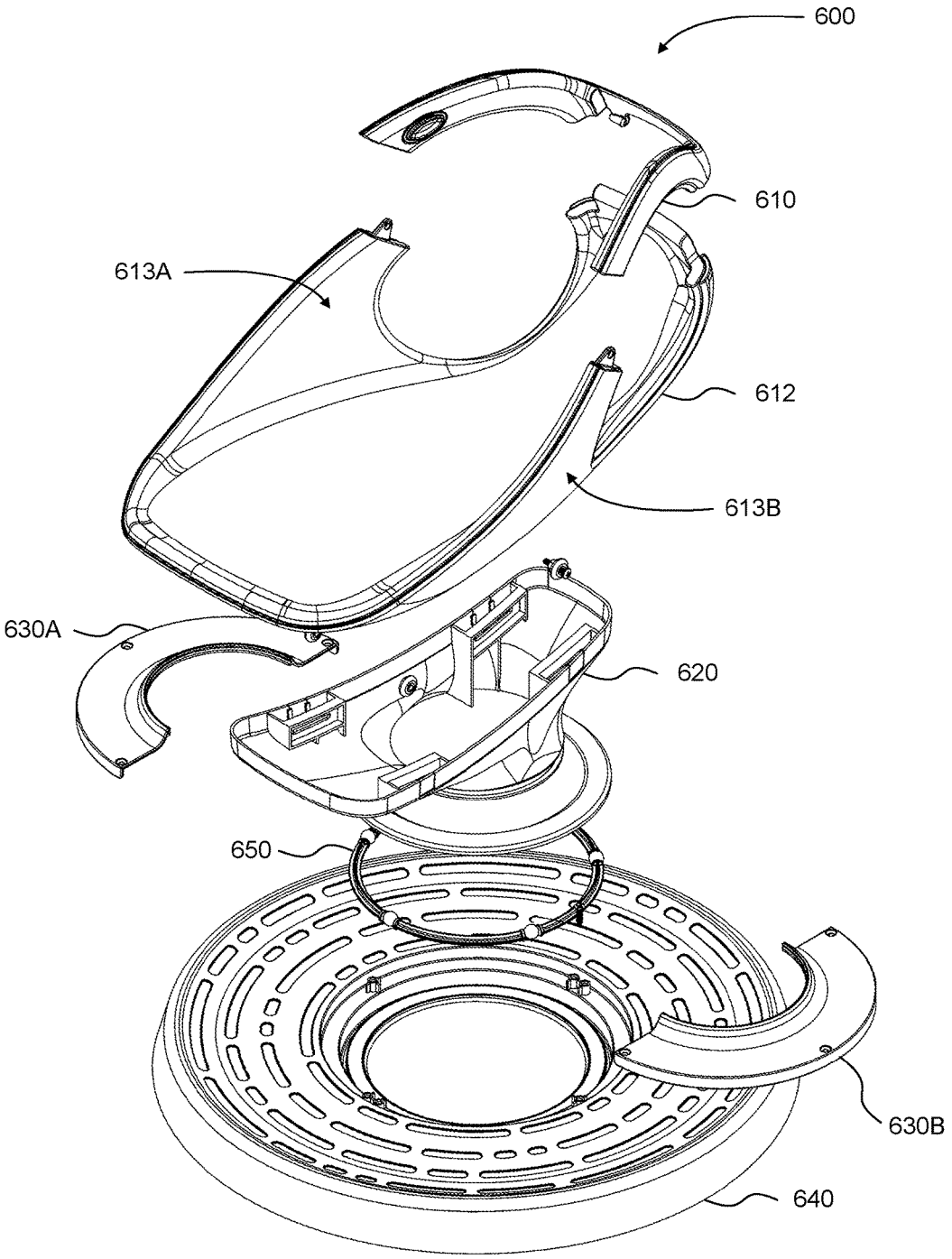
FIG. 6 illustrates an exploded perspective view of a second example infant support device in accordance with this application.

FIG. 6 illustrates an exploded perspective view of a second example infant support device 600 in accordance with this application. Example infant support device 600 comprises a support element 612. As illustrated, support element 612 may comprise a cushioned interior portion. Support element 612 is configured to receive and support an infant using device 600. In the example embodiment, support element 612 comprises a cushion manufactured of a flexible material that will provide comfort to an infant using device 600. The underside or exterior of support element 612 may be a rigid element that supports the cushion.

In the example embodiment, support element 612 comprises several contours. For example, support element 612 defines two side contours, 613A and 613B. The side contours 613A and 613B support an infant laterally within the device, thereby maintaining a proper orientation and preventing the infant from laterally falling out of the device. Additional lateral support and retention is provided by retaining element 610. Retaining element 610 cooperates with support element 612 to define a pair of apertures, shown more clearly in FIGS. 7-10, which are configured to receive the infant's arms. Support element 612 is attached to a swivel frame 620. In the example embodiment, support element 612 and swivel frame 620 may be secured together using fasteners, not shown.

Swivel frame 620 comprises a generally circular lower edge which is configured to receive a bearing or set of bearings 650, and the lower edge of swivel frame 620 is sized to mate with a base 640. Base 640 supports and distributes the weight of the device 600 as well as the weight of an infant using the device. Base 640 defines a generally circular cavity which receives bearing 650 and the lower edge of swivel frame 620.

When properly assembled, bearing 650 is disposed between the lower surface of swivel frame 620 and the upper surface within the cavity defined by base 640. Bearing 650 is disposed between, and in frictional contact with, the lower surface of swivel frame 620 and the upper surface of base 640 within the cavity defined by base 640. Retaining flange 330, comprising portions 630A and 630B, is secured to base 640, thereby holding swivel frame 620, bearing 650 and base 640 in vertical relation to each other. Swivel frame 620, bearing 650, and retaining flange 630 define a swivel assembly 660 that permits 360 degree rotation of swivel frame 620 with respect to base 640.

Figure 7:
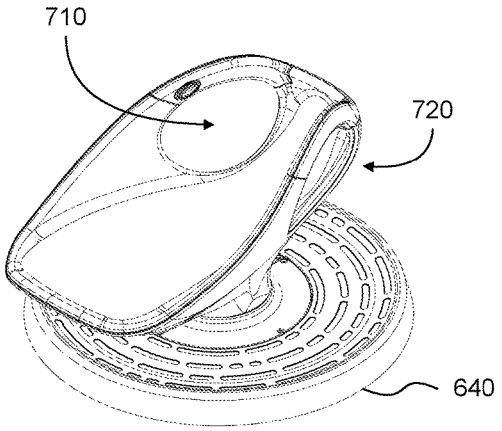
FIG. 7 illustrates a perspective view of the example infant support device of FIG. 6.
Figure 8:
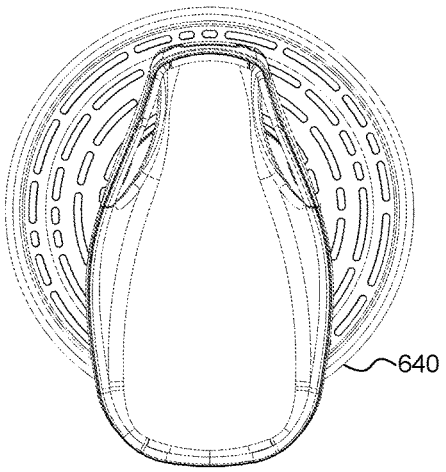
FIG. 8 illustrates a top view of the example infant support device of FIG. 6.
Figure 9:
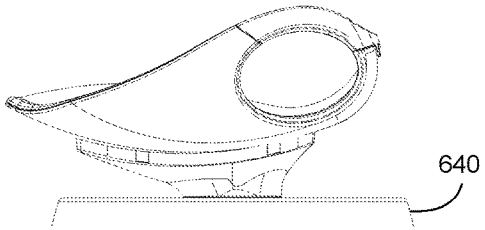
FIG. 9 illustrates a rear view of the example infant support device of FIG. 6.
Figure 10:
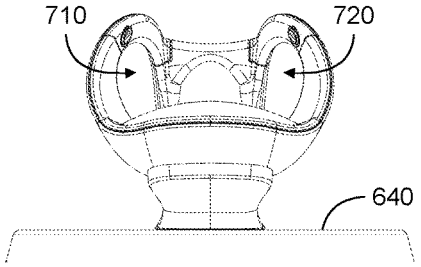
FIG. 10 illustrates a right side view of the example infant support device of FIG. 6.

FIG. 7 illustrates a perspective view of the example infant support device of FIG. 6. FIG. 8 illustrates a top view of the example infant support device of FIG. 6. FIG. 9 illustrates a rear view of the example infant support device of FIG. 6. FIG. 10 illustrates a right side view of the example infant support device of FIG. 6.

As shown in FIGS. 7-10, example infant support device 600 defines a pair of retention apertures 710 and 720. Retention apertures 710 and 720 are configured to enable an infant's arms to pass through the apertures when the infant is using infant support device 600. The retention apertures 710 and 720 prevent the infant from falling out of infant support device 600.

While the systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. An infant support device, comprising:

a base, wherein the base is configured to rest on a substantially flat, horizontal surface;

a swivel frame having a first end and a second end, the swivel frame being rotatable 360 degrees about an axis normal to the first and second ends, the swivel frame being rotatably connected to the base at the first end; and a support element, the support element forming a pair of retention apertures, each retention aperture configured to receive a limb of an infant, the support element being connected to the swivel frame at the second end, whereby the support element is rotatable 360 degrees with respect to the base about an axis normal to the base and the infant support device.

2. The infant support device of claim 1 further comprising a cushion.

3. The infant support device of claim 2 wherein the cushion is contoured to mate with at least a portion of the support element.

4. The infant support device of claim 2 wherein the cushion is attached to at least a portion of the support element.

5. The infant support device of claim 1 further comprising a bearing disposed between the first end of the swivel frame and the base.

6. The infant support device of claim 5 further comprising a retaining flange configured to secure the swivel frame to the base.

7. The infant support device of claim 1 wherein the support element is contoured to hold an infant and the support element comprises a plurality of side contours to prevent the infant from falling out of the infant support device.

8. The infant support device of claim 7 wherein the support element further comprises a rear contour to prevent the infant from falling out of the infant support device.

9. An infant support device, comprising:

a base, wherein the base is configured to rest on a substantially flat, horizontal surface, the base defining a generally circular recessed cavity;

a bearing disposed within the cavity defined by the base;

a swivel frame having a first end and a second end, the first end being generally circular and sized to fit within the cavity defined by the base;

a retaining flange attached to the base, the retaining flange retaining the swivel frame and the bearing in vertical relation to the base; and a support element attached to the second end of the swivel frame, whereby the support element and the swivel frame are rotatable 360 degrees with respect to the base about an axis normal to the base and the infant support device, the support element forming a pair of retention apertures, each retention aperture configured to receive a limb of an infant.

10. The infant support device of claim 9 further comprising a cushion.

11. The infant support device of claim 10 wherein the cushion is contoured to mate with at least a portion of the support element.

12. The infant support device of claim 10 wherein the cushion is attached to at least a portion of the support element.

13. The infant support device of claim 9 wherein the support element is contoured to hold an infant and the support element comprises a plurality of side contours to prevent the infant from falling out of the infant support device.

14. The infant support device of claim 13 wherein the support element further comprises a rear contour to prevent the infant from falling out of the infant support device.

15. An infant support device, comprising:

a base, wherein the base is configured to rest on a substantially flat, horizontal surface;

a swivel assembly having a first end and a second end, the first end being rotatable 360 degrees with respect to the second end about an axis normal to the first and second ends, the swivel assembly being connected to the base at the first end; and a support element, the support element being connected to the swivel assembly at the second end, the support element having a pair of upwardly contoured lateral sides, the support element forming a retention aperture within each upwardly contoured lateral side, the retention aperture is configured to receive a limb of an infant, thereby retaining the infant within the infant support device, and whereby the support element is rotatable 360 degrees with respect to the base about an axis normal to the base and the infant support device.

* * * * *